US011820028B2

(12) United States Patent
Makari

(10) Patent No.: US 11,820,028 B2
(45) Date of Patent: Nov. 21, 2023

(54) FOLDING KNIFE

(71) Applicant: SPYDERCO, INC., Golden, CO (US)

(72) Inventor: Junpei Makari, Fukuoka (JP)

(73) Assignee: SPYDERCO, INC., Golden, CO (US)

( * ) Notice: Subject to any disclaimer, the term of this patent is extended or adjusted under 35 U.S.C. 154(b) by 0 days.

(21) Appl. No.: 17/132,236

(22) Filed: Dec. 23, 2020

(65) Prior Publication Data

US 2021/0291386 A1 Sep. 23, 2021

(30) Foreign Application Priority Data

Nov. 12, 2019 (JP) ..... 2019-204706

(51) Int. Cl.
*B26B 1/04* (2006.01)

(52) U.S. Cl.
CPC ..... *B26B 1/04* (2013.01)

(58) Field of Classification Search
CPC .... B26B 1/02; B26B 1/06; B26B 1/00; B26B 1/04–048
USPC ..... 30/155, 158–161
See application file for complete search history.

(56) References Cited

U.S. PATENT DOCUMENTS 364,414 A * 6/1887 Hollweg ..... B26B 1/046 30/160
462,141 A 10/1891 Kruschke
492,084 A 2/1893 Brigham
533,219 A * 1/1895 Hardy ..... B26B 1/02 30/158
552,077 A 12/1895 Wagner
557,818 A 4/1896 Hotchkiss
589,737 A 9/1897 Miller
589,738 A 9/1897 Miller
600,442 A 3/1898 Nell
616,689 A * 12/1898 Ruettgers ..... B26B 1/02 30/158
689,513 A * 12/1901 Papendell ..... B26B 1/02 30/158
698,080 A 4/1902 Treas
(Continued)

FOREIGN PATENT DOCUMENTS

CA 1130567 8/1982
CN 1106247 4/2003
(Continued)

OTHER PUBLICATIONS

Picture of a C40 Jot Singh Khalsa CLIPIT, date unknown, 1 page.
(Continued)

*Primary Examiner* — Adam J Eiseman
*Assistant Examiner* — Richard D Crosby, Jr.
(74) *Attorney, Agent, or Firm* — Sheridan Ross P.C.

(57) ABSTRACT

A folding knife includes a movable piece that is attached to a blade and a handle so as to be relatively rotatable by a specific rotation angle with respect to the blade, and to rotate with respect to the handle together with the blade outside the specific rotation angle; a notch or a recess formed at a position near a rotating shaft portion on the back side of the blade; a protrusion that is formed at a position on the movable piece and in a shape corresponding to the notch or recess of the blade; and a rotation mechanism including the rotating shaft portion that allows the movable piece to rotate with respect to the blade only within a specific rotation angle.

8 Claims, 6 Drawing Sheets

(56) References Cited

U.S. PATENT DOCUMENTS 736,525 A 8/1903 Kaufmann
749,230 A 1/1904 Severance
845,130 A 2/1907 Schrade
988,068 A 3/1911 Beardsley et al.
1,030,058 A 6/1912 Doles
1,362,142 A 12/1920 Rohrer
1,614,949 A 1/1927 Finley
1,803,899 A 5/1931 Fuller
1,864,011 A 6/1932 Brown
1,994,215 A 3/1935 Gaunt
2,098,678 A 11/1937 Schrade
2,263,415 A 11/1941 Berg et al.
2,415,367 A 2/1947 Pavlovic
2,461,941 A 2/1949 Sutton
2,481,309 A 9/1949 Gunnarson
D166,064 S 3/1952 Blecher
2,630,114 A 3/1953 Hart
2,889,621 A 6/1959 Bassett
3,006,443 A 10/1961 Siler
3,263,329 A 8/1966 Hennessy
D224,388 S 7/1972 Wood
D224,389 S 7/1972 Wood
3,731,961 A 5/1973 Becker
D227,071 S 6/1973 Bernadotte
D229,472 S 12/1973 Collins
3,783,509 A * 1/1974 Lake ..... B26B 1/042 D8/9
3,871,141 A 3/1975 Bonapace
D237,458 S 11/1975 Laughlin
3,930,309 A 1/1976 Collins
3,942,394 A 3/1976 Juranitch
4,040,181 A 8/1977 Johnson
4,070,011 A 1/1978 Glesser
4,083,110 A 4/1978 Goldin et al.
4,124,939 A 11/1978 Onoue
4,133,106 A * 1/1979 Addis ..... B26B 1/04 30/160
4,170,061 A 10/1979 Henry
D256,427 S 8/1980 Lile
D256,981 S 9/1980 Sakurai
D257,056 S 9/1980 Spivey
4,231,194 A 11/1980 Glesser
D257,612 S 12/1980 Goldin et al.
4,240,201 A 12/1980 Sawby et al.
4,266,591 A 5/1981 F'Geppert
4,272,887 A 6/1981 Poehlmann
4,274,200 A 6/1981 Coder
4,347,665 A * 9/1982 Glesser ..... B26B 1/042 30/161
4,356,631 A 11/1982 Guth
4,393,539 A 7/1983 Weissman
4,394,096 A 7/1983 Stevens
D270,655 S 9/1983 Collins
4,408,394 A 10/1983 Phelps
4,447,950 A 5/1984 Mizelle
4,451,982 A 6/1984 Collins
D275,448 S 9/1984 Ferraro
D277,536 S 2/1985 Baer
4,502,221 A * 3/1985 Pittman ..... B26B 1/04 30/160
4,535,539 A 8/1985 Friedman et al.
D280,427 S 9/1985 Jones
4,546,510 A 10/1985 Harrison
4,604,803 A 8/1986 Sawby
4,607,432 A 8/1986 Montgomery
4,640,058 A 2/1987 Glesser
D288,898 S 3/1987 Osterhout
4,696,129 A 9/1987 Roberts
4,697,673 A 10/1987 Omata
4,703,560 A 11/1987 Brooker
4,719,700 A 1/1988 Taylor, Jr.
4,730,393 A 3/1988 Coburn
D296,518 S 7/1988 Sadler
4,759,153 A 7/1988 Cohen
4,776,094 A 10/1988 Glesser
4,778,094 A 10/1988 Fishback
4,805,303 A 2/1989 Gibbs
4,811,486 A 3/1989 Cunningham
4,819,289 A 4/1989 Gibbs
D302,649 S 8/1989 Porsche et al.
D302,650 S 8/1989 Giordano
D302,934 S 8/1989 Finn
D303,210 S 9/1989 Thompson
D304,154 S 10/1989 Osterhout
4,901,439 A 2/1990 Boyd, Jr.
D308,009 S 5/1990 Evrell
D310,014 S 8/1990 Inman
4,947,551 A 8/1990 Deisch
4,947,552 A 8/1990 Barnes
D310,621 S 9/1990 Thompson
4,974,323 A 12/1990 Cassady
4,985,998 A 1/1991 Howard
D317,037 S 5/1991 Koshiishi
5,044,079 A 9/1991 Gibbs
5,060,379 A 10/1991 Neely
5,060,890 A 10/1991 Utterback et al.
D321,820 S 11/1991 Russell
D324,899 S 3/1992 Thompson
5,093,995 A 3/1992 Jan
5,095,624 A 3/1992 Ennis
5,111,581 A 5/1992 Collins
5,131,149 A 7/1992 Thompson et al.
5,153,995 A 10/1992 Opinel
D333,081 S 2/1993 Glesser
D333,251 S 2/1993 Glesser
D333,859 S 3/1993 Meyer
D336,232 S 6/1993 Thompson et al.
D337,253 S 7/1993 Glesser
D344,006 S 2/1994 Glesser
5,293,690 A 3/1994 Cassady
5,297,340 A * 3/1994 Kahlcke ..... D05B 89/00 30/155
D347,375 S 5/1994 Sakai
D348,599 S 7/1994 Sakai
5,325,588 A 7/1994 Rogers
D349,837 S 8/1994 Glesser
D353,988 S 1/1995 Glesser
5,379,492 A 1/1995 Glesser
D356,723 S 3/1995 Sakai
5,400,509 A 3/1995 Kass
5,425,175 A 6/1995 Rogers
D363,871 S 11/1995 Coggins
D365,266 S 12/1995 Hasegawa
D366,408 S 1/1996 Sessions et al.
D367,599 S 3/1996 Sakai
5,495,673 A 3/1996 Gardiner et al.
5,495,674 A 3/1996 Taylor, Jr.
5,502,895 A 4/1996 Lemaire
5,511,310 A 4/1996 Sessions et al.
5,515,610 A 5/1996 Levin et al.
D371,288 S 7/1996 Thompson
5,537,750 A 7/1996 Seber et al.
5,542,139 A 8/1996 Boivin
5,546,662 A 8/1996 Seber et al.
D373,716 S 9/1996 Keys et al.
5,572,793 A 11/1996 Collins et al.
5,580,019 A 12/1996 Glesser
5,581,888 A 12/1996 Lewis
D377,443 S 1/1997 Seber et al.
5,594,966 A 1/1997 Goldman
5,596,808 A 1/1997 Lake et al.
D378,982 S 4/1997 Thompson
5,615,484 A 4/1997 Pittman
D379,294 S 5/1997 Lum
5,628,117 A 5/1997 Glesser
D379,579 S 6/1997 Pohl
D381,060 S 7/1997 Moran
D382,189 S 8/1997 Viele
D382,459 S 8/1997 Khalsa
5,661,908 A 9/1997 Chen
D384,871 S 10/1997 McWillis
D385,173 S 10/1997 McWillis
D386,664 S 11/1997 Glesser
5,685,079 A 11/1997 Brothers et al.

(56) References Cited

U.S. PATENT DOCUMENTS 5,689,890 A 11/1997 Glesser
D387,966 S 12/1997 Horn
D387,996 S 12/1997 Horn
D388,150 S 12/1997 Glesser
D389,389 S 1/1998 Glesser
D389,718 S 1/1998 Wegner
5,704,129 A 1/1998 Glesser
D391,465 S 3/1998 Glesser
D392,539 S 3/1998 Balolia
5,722,168 A 3/1998 Huang
5,737,841 A 4/1998 McHenry et al.
5,755,035 A 5/1998 Weatherly
5,765,247 A 6/1998 Seber et al.
D396,657 S 8/1998 Nagai et al.
D397,017 S 8/1998 Pardue
D397,020 S 8/1998 Pardue
5,794,346 A 8/1998 Seber et al.
5,799,400 A 9/1998 Glesser
5,822,866 A 10/1998 Pardue
5,826,340 A 10/1998 Hull
D402,178 S 12/1998 Glesser
D402,524 S 12/1998 Glesser
D403,567 S 1/1999 Glesser
D404,990 S 2/1999 Zowada
D405,338 S 2/1999 Balolia
D407,002 S 3/1999 Morton et al.
5,878,500 A * 3/1999 Emerson ..... B26B 1/02 224/232
5,887,347 A 3/1999 Gibbs
D408,706 S 4/1999 Elishewitz
D409,070 S 5/1999 Elishewitz
D411,431 S 6/1999 Glesser
D411,790 S 7/1999 Glesser
D412,355 S 7/1999 Saetherbo
5,920,935 A 7/1999 Beck
5,953,821 A 9/1999 Mearns
5,964,036 A 10/1999 Centofante
5,983,506 A 11/1999 Glesser
D418,383 S 1/2000 Bradichansky
D421,378 S 3/2000 Glesser
D422,190 S 4/2000 Zaha
D422,476 S 4/2000 McHenry et al.
D422,477 S 4/2000 Elishewitz
D422,478 S 4/2000 Elishewitz
D422,479 S 4/2000 Pardue
D422,480 S 4/2000 McHenry et al.
D422,669 S 4/2000 Elishewitz
D422,871 S 4/2000 Terzuola
D422,873 S 4/2000 McHenry et al.
D422,877 S 4/2000 Elishewitz
D425,389 S 5/2000 Elishewitz
D425,391 S 5/2000 Bradichansky
D426,132 S 6/2000 Pardue
6,088,861 A 7/2000 Sessions et al.
D428,789 S 8/2000 McHenry et al.
D429,138 S 8/2000 Glesser
6,101,722 A 8/2000 Cheng
6,101,723 A 8/2000 Ford
6,101,724 A 8/2000 Halligan
6,122,829 A 9/2000 McHenry et al.
D431,991 S 10/2000 Elishewitz
D432,386 S 10/2000 Elishewitz
6,125,543 A 10/2000 Jhones
D433,913 S 11/2000 Pardue
D434,631 S 12/2000 Lum
D435,420 S 12/2000 Ayoob
6,154,965 A 12/2000 Sakai
D436,014 S 1/2001 Glesser
6,170,104 B1 1/2001 Seber et al.
D438,442 S 3/2001 Osborne
D438,443 S 3/2001 Keating
6,205,667 B1 3/2001 Glesser
D441,827 S 5/2001 Frank
D442,460 S 5/2001 Glesser
D442,461 S 5/2001 Glesser
D442,841 S 5/2001 Balolia
6,289,592 B1 9/2001 Emerson
6,305,085 B1 10/2001 Stallegger et al.
6,308,420 B1 10/2001 Moser
6,314,646 B1 11/2001 Schmidt
6,338,431 B1 1/2002 Onion
6,360,443 B1 3/2002 Remus
6,363,615 B1 4/2002 Moser
6,370,778 B1 4/2002 Conable
6,378,214 B1 4/2002 Onion
6,397,477 B1 6/2002 Collins
D461,387 S 8/2002 Glesser
6,427,335 B1 8/2002 Ralph
6,430,816 B2 8/2002 Neveux
6,438,848 B1 8/2002 McHenry et al.
D464,551 S 10/2002 Glesser
6,490,797 B1 12/2002 Lake et al.
6,523,265 B2 * 2/2003 Eickhorn ..... B26B 1/042 30/155
6,553,672 B2 4/2003 Glesser et al.
D474,669 S 5/2003 Onion
6,574,869 B1 6/2003 McHenry et al.
6,591,505 B2 7/2003 Flavigny
6,618,947 B1 9/2003 Gardiner et al.
6,675,484 B2 1/2004 McHenry et al.
6,701,621 B2 3/2004 Kain et al.
D488,045 S 4/2004 Onion
6,725,545 B2 4/2004 Frank
6,732,436 B2 5/2004 Moizis
6,751,868 B2 6/2004 Glesser
D495,940 S 9/2004 Keppel et al.
6,789,323 B2 9/2004 Moizis
6,810,588 B1 11/2004 Cheng
6,836,967 B1 1/2005 Sakai
6,918,184 B2 7/2005 Glesser
D509,124 S 9/2005 Keppel et al.
6,941,661 B2 9/2005 Frazer
6,959,494 B2 11/2005 Taylor
7,032,315 B1 4/2006 Busse
D520,843 S 5/2006 Voros
7,051,441 B2 5/2006 Carter, III
D523,317 S 6/2006 Ryan et al.
7,059,053 B2 6/2006 Sakai
7,107,685 B1 * 9/2006 Anderson ..... B26B 1/044 30/158
7,146,736 B1 * 12/2006 Collins ..... B26B 1/042 30/159
7,243,430 B1 7/2007 Lerch
7,249,417 B2 7/2007 Chu
D553,467 S 10/2007 Ryan
D553,469 S 10/2007 Onion
7,293,360 B2 11/2007 Steigerwalt et al.
7,305,768 B2 12/2007 Hinderer
7,305,769 B2 12/2007 McHenry et al.
7,340,836 B2 3/2008 Whitemiller et al.
D566,222 S 4/2008 Hawk et al.
D567,055 S 4/2008 Renzi et al.
D569,213 S 5/2008 Renzi et al.
D573,864 S 7/2008 Glesser
7,406,896 B2 8/2008 Rivera
7,409,766 B2 8/2008 Steigerwalt
7,437,822 B2 10/2008 Flagg et al.
D581,240 S 11/2008 Glesser et al.
7,458,159 B2 12/2008 Galyean et al.
7,533,466 B2 5/2009 Steigerwalt
D593,838 S 6/2009 Williams
7,543,386 B2 6/2009 Sullivan
7,555,839 B2 7/2009 Koelewyn
7,562,454 B2 7/2009 Steigerwalt et al.
7,562,455 B2 7/2009 McHenry et al.
7,627,951 B2 12/2009 Glesser et al.
7,676,931 B2 3/2010 Knight et al.
7,676,932 B2 3/2010 Grice
RE41,259 E 4/2010 McHenry et al.
7,694,421 B2 4/2010 Lin
D614,933 S 5/2010 Freeman
7,774,940 B2 * 8/2010 Frank ..... B26B 1/044 30/155
7,905,023 B2 3/2011 Westerfield

(56) References Cited

U.S. PATENT DOCUMENTS

| | | | | |
|---|---|---|---|---|
| 7,918,028 | B2 | 4/2011 | Steigerwalt et al. | |
| 7,987,601 | B2 | 8/2011 | Nakamura | |
| 8,020,302 | B2 * | 9/2011 | Kao | B26B 1/02 30/155 |
| 8,042,276 | B2 | 10/2011 | Lerch et al. | |
| 8,082,671 | B2 | 12/2011 | Saegesser | |
| 8,161,653 | B2 | 4/2012 | Nenadic | |
| 8,261,633 | B2 | 9/2012 | Maxey | |
| 8,296,958 | B1 * | 10/2012 | Frazer | B26B 1/042 30/158 |
| 8,402,663 | B2 | 3/2013 | McHenry et al. | |
| 8,468,701 | B1 | 6/2013 | Perez | |
| D686,900 | S | 7/2013 | Ohlrich | |
| 8,505,206 | B2 | 8/2013 | VanHoy | |
| 8,572,851 | B2 | 11/2013 | Duey | |
| 8,607,460 | B1 | 12/2013 | Lerch et al. | |
| D697,780 | S | 1/2014 | Pelton | |
| D699,315 | S | 2/2014 | Seeds et al. | |
| 8,646,184 | B2 | 2/2014 | Westerfield | |
| 8,745,878 | B2 | 6/2014 | Glesser et al. | |
| 8,978,253 | B2 | 3/2015 | Snyder et al. | |
| D739,697 | S | 9/2015 | Glesser | |
| D743,769 | S | 11/2015 | Glesser | |
| D747,946 | S | 1/2016 | Carey | |
| D752,412 | S | 3/2016 | Mears | |
| D753,459 | S | 4/2016 | Glesser | |
| 9,327,413 | B2 * | 5/2016 | Sakai | B26B 1/042 |
| 1,194,503 | A1 | 8/2016 | Jawoisch | |
| 9,492,916 | B2 | 11/2016 | Snyder et al. | |
| 9,592,612 | B2 | 3/2017 | Koenig | |
| D814,902 | S | 4/2018 | Berenji et al. | |
| 9,943,970 | B2 * | 4/2018 | Glesser | B26B 1/048 |
| D816,457 | S | 5/2018 | Demko | |
| D835,490 | S | 12/2018 | Glesser | |
| 10,569,432 | B2 * | 2/2020 | Halucha | B26B 1/04 |
| D918,689 | S | 5/2021 | Glesser et al. | |
| D919,400 | S | 5/2021 | Glesser et al. | |
| D919,401 | S | 5/2021 | Clinton | |
| 2001/0022113 | A1 | 9/2001 | Kojima et al. | |
| 2001/0023541 | A1 | 9/2001 | Blanchard | |
| 2003/0019108 | A1 | 1/2003 | McHenry et al. | |
| 2004/0154169 | A1 | 8/2004 | McCann | |
| 2004/0231163 | A1 | 11/2004 | Sakai | |
| 2004/0244205 | A1 | 12/2004 | Linn et al. | |
| 2005/0072005 | A1 | 4/2005 | Taylor | |
| 2006/0064877 | A1 | 3/2006 | Vallotton et al. | |
| 2006/0123632 | A1 | 6/2006 | Linn et al. | |
| 2006/0168817 | A1 | 8/2006 | Kao | |
| 2006/0168819 | A1 | 8/2006 | Perreault | |
| 2006/0272158 | A1 | 12/2006 | Williams | |
| 2007/0068000 | A1 * | 3/2007 | Onion | B26B 1/044 30/158 |
| 2007/0169351 | A1 | 7/2007 | Steigerwalt | |
| 2008/0201953 | A1 | 8/2008 | Bremer et al. | |
| 2008/0222896 | A1 | 9/2008 | Marfione et al. | |
| 2008/0289198 | A1 | 11/2008 | Kaiser et al. | |
| 2009/0056146 | A1 | 3/2009 | Duey | |
| 2009/0133267 | A1 | 5/2009 | Steigerwalt et al. | |
| 2009/0144986 | A1 | 6/2009 | Frazer | |
| 2009/0183374 | A1 | 7/2009 | Kao | |
| 2009/0193664 | A1 | 8/2009 | Galyean | |
| 2009/0223061 | A1 | 9/2009 | Seber et al. | |
| 2009/0241348 | A1 | 10/2009 | Westerfield | |
| 2009/0271989 | A1 | 11/2009 | VanHoy | |
| 2009/0313765 | A1 * | 12/2009 | Krudo | B26B 11/00 30/158 |
| 2010/0218383 | A1 | 9/2010 | Williams | |
| 2010/0236078 | A1 | 9/2010 | Duey | |
| 2010/0299934 | A1 | 12/2010 | VanHoy | |
| 2011/0099817 | A1 | 5/2011 | Duey | |
| 2012/0180319 | A1 * | 7/2012 | Vellekamp | B26B 1/02 30/158 |
| 2013/0125403 | A1 | 5/2013 | Westerfield | |
| 2013/0212887 | A1 | 8/2013 | De Buyer-Mimeure | |
| 2013/0233113 | A1 | 9/2013 | Saitoh | |
| 2013/0263455 | A1 | 10/2013 | Collins et al. | |
| 2013/0291389 | A1 * | 11/2013 | Chen | B26B 1/048 30/158 |
| 2013/0305541 | A1 | 11/2013 | Koenig | |
| 2014/0047718 | A1 | 2/2014 | Fellows et al. | |
| 2014/0115899 | A1 | 5/2014 | Frazer | |
| 2014/0373364 | A1 | 12/2014 | Li | |
| 2015/0128426 | A1 | 5/2015 | Sakai | |
| 2015/0343650 | A1 * | 12/2015 | Valdez | B26B 1/044 30/158 |
| 2016/0136824 | A1 | 5/2016 | Glesser | |
| 2017/0232621 | A1 * | 8/2017 | Sung | B26B 1/02 30/158 |
| 2020/0215705 | A1 | 7/2020 | Glesser et al. | |

FOREIGN PATENT DOCUMENTS

| | | |
|---|---|---|
| CN | 1328021 | 7/2007 |
| CN | 1638925 | 5/2010 |
| CN | 101193730 | 5/2010 |
| CN | 101687324 | 11/2012 |
| CN | 103298589 | 9/2013 |
| DE | 3041584 | 6/1982 |
| DE | 20109376 | 8/2001 |
| DE | 69821034 | 11/2004 |
| EP | 1071546 | 1/2001 |
| EP | 2183080 | 5/2010 |
| EP | 2663430 | 11/2013 |
| FR | 829446 | 6/1938 |
| FR | 2495986 | 6/1982 |
| FR | 2906750 | 4/2008 |
| GB | 189822620 | 12/1898 |
| GB | 578252 | 6/1946 |
| GB | 753590 | 7/1956 |
| GB | 2084058 | 9/1980 |
| JP | S56-175905 | 12/1981 |
| JP | 2003-10568 | 1/2003 |
| WO | WO 95/11116 | 4/1995 |
| WO | WO 2007/055049 | 5/2007 |
| WO | WO 2014/039254 | 3/2014 |
| WO | WO 2014/039255 | 3/2014 |
| WO | WO 2014/130333 | 8/2014 |
| WO | WO 2014/130905 | 8/2014 |

OTHER PUBLICATIONS

"The Bud K Catalog", Bud K Worldwide, Early Fall 2000, p. 3, front and back cover.
"SPYDERCO "CLIPITSTM" Flip Open With One Hand", date unknown, p. 28.
"Knives and Tools for Modern Man", The Edge Company, date unknown, p. 25.
"Ironstone", Catalog of Knives and Accessories, Fall/Winter 1995-1996, cover, pp. 6-7 and 10-13.
"SPYDERCO "CLIPITSTM"", date unknown, pp. 30-31.
Catolog page featuring Gerber Knives, Winter 1995/96, p. 32.
"Dear Spyderco Customer" Letter from Spyderco, Inc., Nov. 1, 2006, 2 pages.
"To Our Valuable Distributors and Dealers" Letter from Spyderco, Inc., Nov. 1, 2006, 4 pages.
"SpyderEdge", Spyderco, Inc., 4th Quarter, 2001, pp. 1-6.
"Sprderco 2001 Dealer Catalog", Spyderco, Inc. 2001, 40 pages.
"Spyderco Y2K Dealer Catalog", Spyderco, Inc., 2000, 36 pages.
"Spyderco 2007 Product Guide", Spyderco, Inc. 2007, 74 pages.
"Spyderco 2007 Dealer Pricing", Spyderco, Inc., 2007, 4 pages.
"Latest Designs from Spyderco", date unkown, pp. 1-2.
"Spyderco Think About It . . . All God's Critters Have Knices", Spyderco, Inc. 1996, 26 pages.
"Welcome to the World of Spyderco", Spyderco Brochure, Spyrderco, Inc., 1998, 42 pages.
"Spyderco 2001" Spyderco, Inc. 2001, 2 pages.
"Spyderco 2002" Spyderco, Inc. 2002, 3 pages.
Gorilla and Sons Catalog, pp. 5, 15, 21 and 57, Junglee, Benchmade, SOG and GKT knives, 1997, 4 pages.

(56) References Cited

OTHER PUBLICATIONS

Russell, "Catalog of Knives", pp. 7, 9 and 29, Spring 1996, 3 pages.
"Spyderco Domino ~ C172CFTI," Spyderco Inc., 2014, 1 page.
"Spyderco Para-Military G-10, C81G," Spyderco Inc., 2004, retrieved from https://www.spyderco.com/catalog/details/C81G/34, retrieved on Jun. 6, 2017, 1 page.
"Spyderco Para-Military G-10 Black, C81G2," Spyderco Inc., 2004, retrieved from https://www.spyderco.com/catalog/details/C81G2/472, retrieved on Jun. 6, 2017, 1 page.
Official Action with English Translation for Japan Patent Application No. 2019-204706, dated Feb. 18, 2020, 6 pages.
Decision to Grant with English Translation for Japan Patent Application No. 2019-204706, dated Apr. 7, 2020, 6 pages.
"Benchmade 2003 Catalog," Axis Lock, 17 pages.
"K.I.S.S. & P.E.C.K." website pages from www.crkt.com/kiss.html, dated Jun. 2, 2008, 3 pages.
"K.I.S.S. Knife from Columbia River Knife and Tool" website pages from http://www.shop.com/K_I_S_S_Knife_from_Columbia_River_Knife_and_Tool-33217878-p!.shtml, dated Jun. 2, 2008, 3 pages.
SOG Knives, Vision, retrieved from http://web.archive.org/web/20020127064214/http://www.sogknives.com/vision.htm, Jan. 27, 2002, 1 page.
SOG Knives, X-ray Vision, retrieved from http://web.archive.org/web/20011208114647/http://www.sogknives.com/xrayvis.htm, Dec. 8, 2001, 1 page.
SOG Knives, Mini X-Ray Vision, retrieved from http://web.archive.org/web/20011211023306/http://www.sogknives.com/minxrvis.htm, Dec. 11, 2001, 1 page.
SOG Knives, Night Vision, retrieved from http://web.archive.org/web/20011208113219/http://www.sogknives.com/nightvis.htm, Dec. 8, 2001, 1 page.
SOG Knives, Sculptura, retrieved from http://web.archive.org/web/20011211022847/http://www.sogknives.com/sculpt.htm, Dec. 11, 2001, 1 page.

* cited by examiner

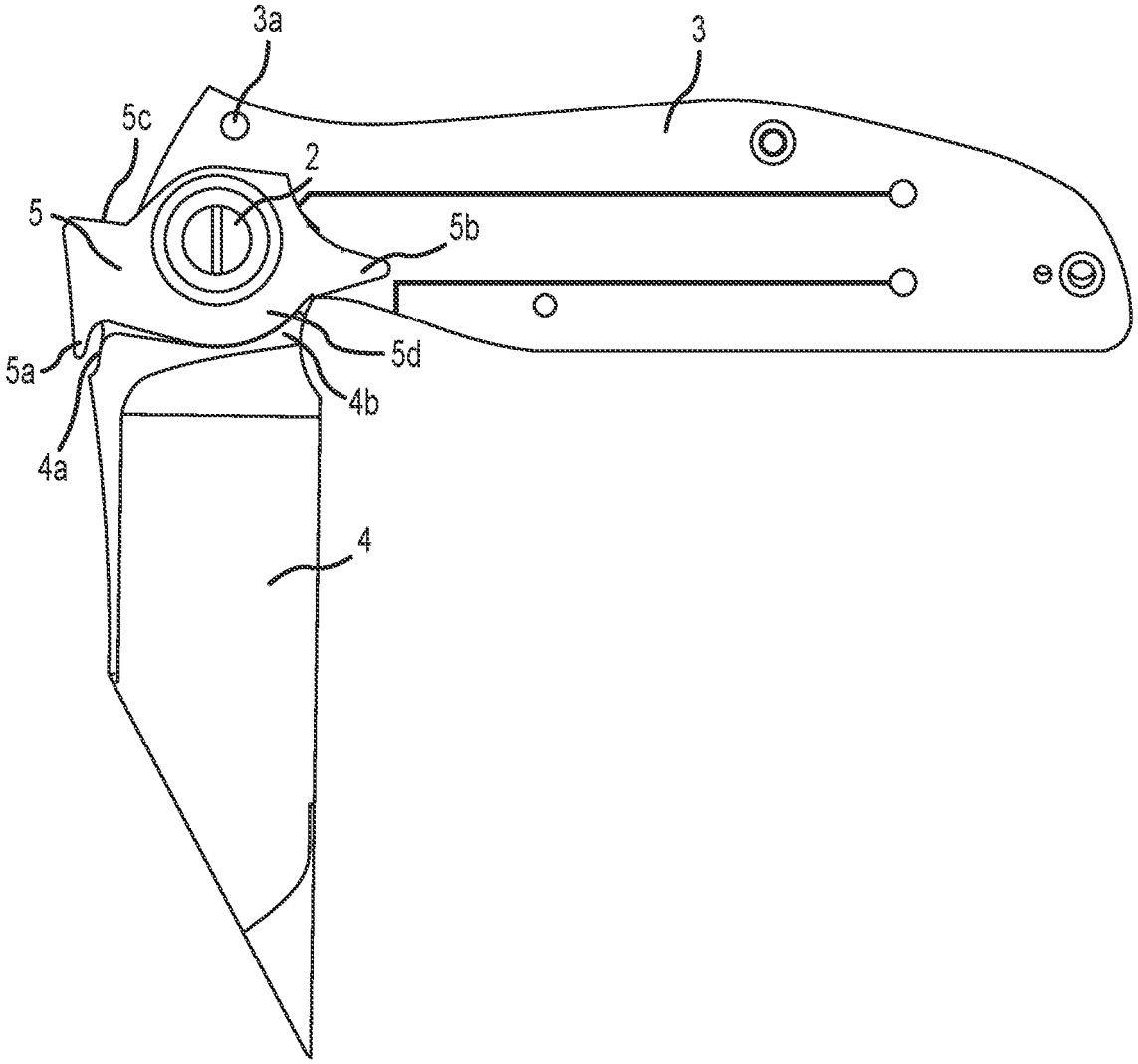
FIG.2A
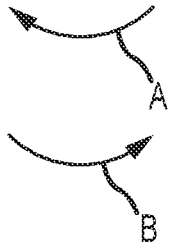

FOLDING KNIFE

CROSS REFERENCE TO RELATED APPLICATIONS

This application claims the benefit of Japan Patent Application No. 2019204706 filed Nov. 12, 2019, the contents of which are incorporated herein by reference in its entirety.

BACKGROUND OF THE INVENTION

Field of the Invention

The present invention relates to a folding knife in which a blade is opened as a result of a protrusion on the blade side catching on a part of the holster (receptacle) or pocket when the knife is taken out of a specific holster or a garment pocket.

Description of the Related Art

Folding knives have been known in the past in which the blade is automatically opened from the handle as a result of a protrusion on the blade side of the knife catching on a part of a holster or a pocket when the knife is taken out of a garment pocket or a pouch or other such holster that is attached to a belt.

FIG. 5 is a diagram showing an example of such a knife, and is a revised copy of a part of the drawings given in U.S. Pat. No. 5,878,500. In the knife 40 shown in FIG. 5, a protrusion (numbered 42 and 44 in FIG. 5) is formed on the rear portion near the rotating shaft (numbered 46 in FIG. 5) of the blade (numbered 48 in FIG. 5). This knife 40 is housed in a holster such as a pouch (numbered 2 in FIG. 5) in its closed state in which the blade 48 is disposed inside the handle (numbered 5 in FIG. 5). In the example shown in FIG. 5, when the closed knife 40 is taken out of its holster 52, the protrusion 42, 44 formed on a part of the blade 48 catches on a part 54 of the holster 52. As a result of the protrusion 42, 44 catching on a part 54 of the holster 52, the entire blade 48 on which the protrusion 42, 44 is formed rotates and comes out of the handle 50, and the blade 48 automatically transitions to its open state in which the blade 48 is fully opened from the handle 50.

CITATION LIST

Patent Literature

Patent Literature 1: U.S. Pat. No. 5,878,500

SUMMARY OF THE INVENTION

Problem to be Solved by the Invention

However, with the prior art folding knife shown in FIG. 5, in which a protrusion is formed on a part of the blade so that the protrusion catches on a part of a holster or a pocket and the blade is automatically opened from the handle, when the blade is in its open state in which the blade is fully opened from the handle, the protrusion (numbered 42 and 44 in FIG. 5) is located on the back side of the blade as shown in FIG. 5*b*. Therefore, when the user tries to cut something such as meat, and the user puts his thumb on the back side of the blade and tries to push the blade down from above, for example (see F in FIG. 5*b*), the user's thumb hits the protrusion, which is painful, so a problem is that the user cannot push down the back side of the blade with sufficient force.

The present invention was conceived by focusing on this problem encountered with the prior art, and it is an object thereof to provide a folding knife with which, when the closed knife is taken out of a specific holster or a garment pocket, as a result of a protrusion on the blade side catching on a part of the holster or pocket, the blade comes out of the handle and is opened, wherein said folding knife prevents the problem whereby the protrusion on the blade side hits the user's thumb when the user puts his thumb on the back side of the blade and pushes the knife down from above, even when the knife is in its open state in which the blade has been fully opened from the handle.

Means for Solving Problem

The folding knife according to the present invention for solving the above problem is a folding knife in which a blade and a handle are rotatably connected to each other so as to be able to transition between a closed state, in which the blade is disposed or accommodated in the handle, and an open state, in which the blade is fully open from the handle, and when the closed knife is taken out of a specific holster or a garment pocket, the blade comes out of the handle and is opened as a result of a protrusion on the blade side catching on a part of the holster or pocket, said folding knife comprising a movable piece that is attached to the blade and the handle so as to be relatively rotatable within a specific rotation angle with the blade, and to rotate with respect to the handle together with the blade outside of the specific rotation angle; a notch or a recess formed at a position near a rotating shaft portion on the back side of the blade; a protrusion that is formed at a position on the movable piece and in a shape corresponding to the notch or recess of the blade, said protrusion being capable of being disposed or accommodated in the notch or recess of the blade when the blade is in its open state; and a rotation mechanism that connects the handle, the blade, and the movable piece to each other by a single rotating shaft portion allows the blade and the movable piece to rotate relative to the handle, and allows the movable piece to rotate relative to the blade only within a specific rotation angle, said rotation mechanism rotating the movable piece relative to the blade so that the protrusion is disposed or accommodated inside the notch or recess of the blade when the blade is in its open state, and so that the protrusion is disposed outside of the notch or recess of the blade when the blade is in its closed state.

Also, the folding knife according to the present invention may be configured such that the rotation mechanism comprises a stopper that is fixed or formed on a part of the handle side; a first stopper contact portion that is fixed or formed on the movable piece side, said first stopper contact portion hitting the stopper when the blade is in its closed state, thereby preventing rotation of the movable piece in the blade closing direction in which the blade rotates from its open state to its closed state, so that the protrusion is disposed outside of the notch or recess of the blade; and a second stopper contact portion that is fixed or formed on the movable piece side, said second stopper contact portion hitting the stopper when the blade is in its open state, thereby preventing rotation of the movable piece in the blade opening direction in which the blade rotates from its closed state to its open state, so that the protrusion is disposed or accommodated inside the notch or recess of the blade.

Also, the folding knife according to the present invention may be configured such that the notch or recess is formed in the blade at a position near the rotating shaft portion and at a position on the opposite side from the cutting edge, and the protrusion is formed in a shape corresponding to the notch or recess.

Also, the folding knife according to the present invention may be configured such that when the blade is in its closed state, the protrusion is disposed at a position away from the notch or recess of the blade by a specific angle in the blade opening direction in which the blade rotates from its closed state to its open state.

Also, the folding knife according to the present invention may be configured as a folding knife in which a blade and a handle are rotatably connected to each other so as to be able to transition between a closed state, in which the blade is disposed or accommodated in the handle, and an open state, in which the blade is fully open from the handle, and when the closed knife is taken out of a specific holster or a garment pocket, the blade comes out of the handle and is open as a result of a protrusion on the blade side catching on a part of the holster or pocket, said folding knife comprising a notch or recess formed at a position on the opposite side from the cutting edge of the blade; a movable piece that is rotatably connected not only with respect to the handle but also partially with respect to the blade; a protrusion in the movable piece, said protrusion being formed in the movable piece so that when the blade is in its closed state, the protrusion is disposed at a position facing the notch or recess and at a position away from the notch or recess by a specific angle in the blade opening direction in which the blade rotates from its closed state to its open state, and is formed in a shape corresponding to the notch or recess; and a rotation mechanism that rotates the movable piece while partially rotating in conjunction with the blade, wherein the rotation mechanism is such that (a) in a closed state in which the blade is disposed in the handle, a protrusion formed on the movable piece is disposed and held at a position away from the notch or recess formed on the back side of the blade near the rotating shaft portion by a specific rotation angle in the blade opening direction in which the blade rotates from its closed state to its open state, (b) while the blade is in the course of transitioning from its closed state to its open state, or while the blade is in the course of transitioning from its open state to its closed state, the movable piece is able to rotate with respect to the blade within a specific rotation angle and is rotated with respect to the handle together with the blade outside the specific rotation angle, and (c) in its open state in which the blade is fully opened from the handle, a protrusion of the movable piece is disposed or accommodated in the notch or recess of the blade.

Effects of the Invention

In the present invention, a rotation mechanism is provided so that the blade and the movable piece are able to rotate relative to the handle, and so that the movable piece is able to rotate relative to the blade by a specific rotation angle, and this rotation mechanism allows the movable piece to rotate relative to the blade within a specific rotation angle so that the protrusion is disposed or accommodated inside the notch or recess of the blade in its open state, and the protrusion is disposed outside of the notch or recess of the blade in its closed state. Consequently, with the present invention, in its open state when the blade is fully opened from the handle, the protrusion of the movable piece can be disposed or accommodated inside the notch or recess of the blade, so when the user puts his thumb on the back side of the blade with the blade open and tries to push the knife down from above, the problem that occurred with a conventional folding knife, in which the protrusion on the blade side ended up hitting the user's thumb, can be effectively avoided.

Also, in the present invention, when there are provided on the movable piece side a first stopper contact portion that hits the stopper on the handle side and thereby prevents the movable piece from rotating in the blade closing direction so that the protrusion is disposed outside of the notch or recess of the blade when the blade is in its closed state, and a second stopper contact portion that hits the stopper on the handle side and thereby prevents the movable piece from rotating in the blade opening direction so that the protrusion is disposed or accommodated inside the notch or recess of the blade when the blade is in its open state, if the blade is in its closed state, the protrusion will be reliably disposed outside of the notch or recess of the blade, and if the blade is in its open state, the protrusion will be reliably disposed or accommodated inside the notch or recess of the blade.

Also, in the present invention, when the notch or recess is formed at a position in the blade that is near the rotating shaft portion and at a position on the opposite side from the cutting edge, and the protrusion is formed at a position in the movable piece that is facing the notch or recess and in a shape that corresponds to the notch or recess, then when the blade completes its transition from its closed state to its open state, the protrusion will be reliably disposed or accommodated inside the notch or recess.

Also, in the present invention, when the blade is in its closed state and the protrusion is disposed at a position away from the notch or recess of the blade by a specific angle in the opening direction, when the user removes the knife from a holster or a pocket, the protrusion will reliably catch on a part of the holster or the pocket, and as a result the blade will rotate so as to come out of the handle.

Furthermore, in the present invention, the rotation mechanism is such that (a) in a closed state in which the blade is disposed or accommodated in the handle, a protrusion formed on the movable piece is disposed and held at a position away from the notch or recess formed on the back side of the blade near the rotating shaft portion by a specific rotation angle in the blade opening direction, (b) in the course in which the blade is transitioning from its closed state to its open state, or in the course in which the blade is transitioning from its open state to its closed state, the movable piece is able to rotate with respect to the blade within a specific rotation angle, and is rotated with respect to the handle together with the blade outside the specific rotation angle, and (c) in its open state in which the blade is fully opened from the handle, a protrusion of the movable piece is disposed or accommodated in the notch of the blade.

Therefore, with the present invention, in its open state in which the blade is fully opened from the handle, the protrusion on the blade side will be disposed or accommodated inside the notch or recess of the blade. Consequently, with the present invention, the problem that occurred with a conventional folding knife, in which the protrusion on the back side of the blade ended up hitting the user's thumb when the user put his thumb on the blade and tried to push the blade down from above in its open state, can be effectively avoided.

BRIEF DESCRIPTION OF DRAWINGS

FIG. 2A is a diagram illustrating the folding knife in the course of transitioning from its closed state to its open state according to Embodiment 1, and is a schematic side view showing the whole knife;

DETAILED DESCRIPTION OF THE INVENTION

First Embodiment

Figure 1:
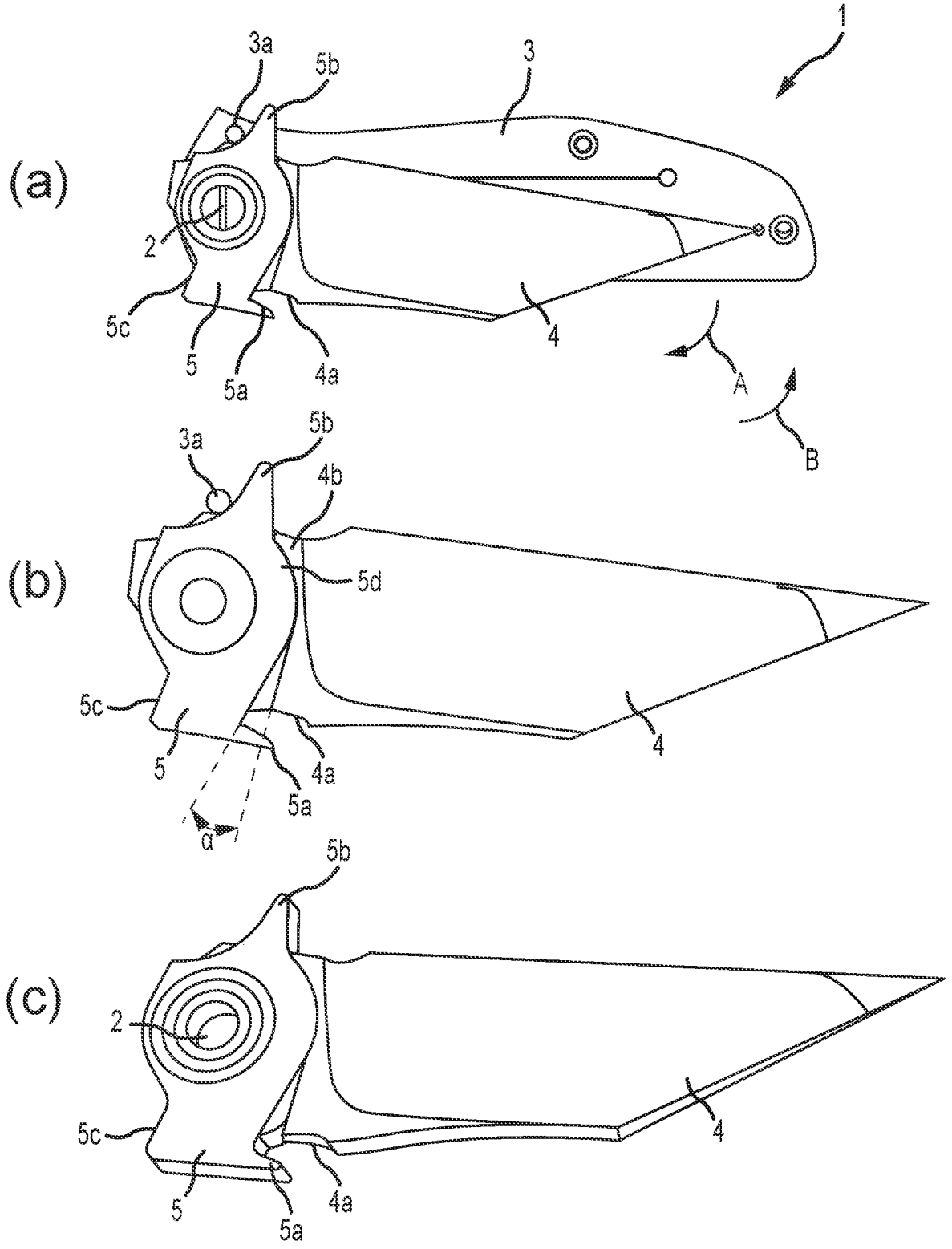
FIG. 1 consists of diagrams illustrating the folding knife in its closed state according to Embodiment 1 of the present invention, where (a) is a schematic side view of the whole knife in Embodiment 1, (b) is a side view of the blade and the movable piece, and (c) is an oblique view of the blade and the movable piece.
Figure 2B:
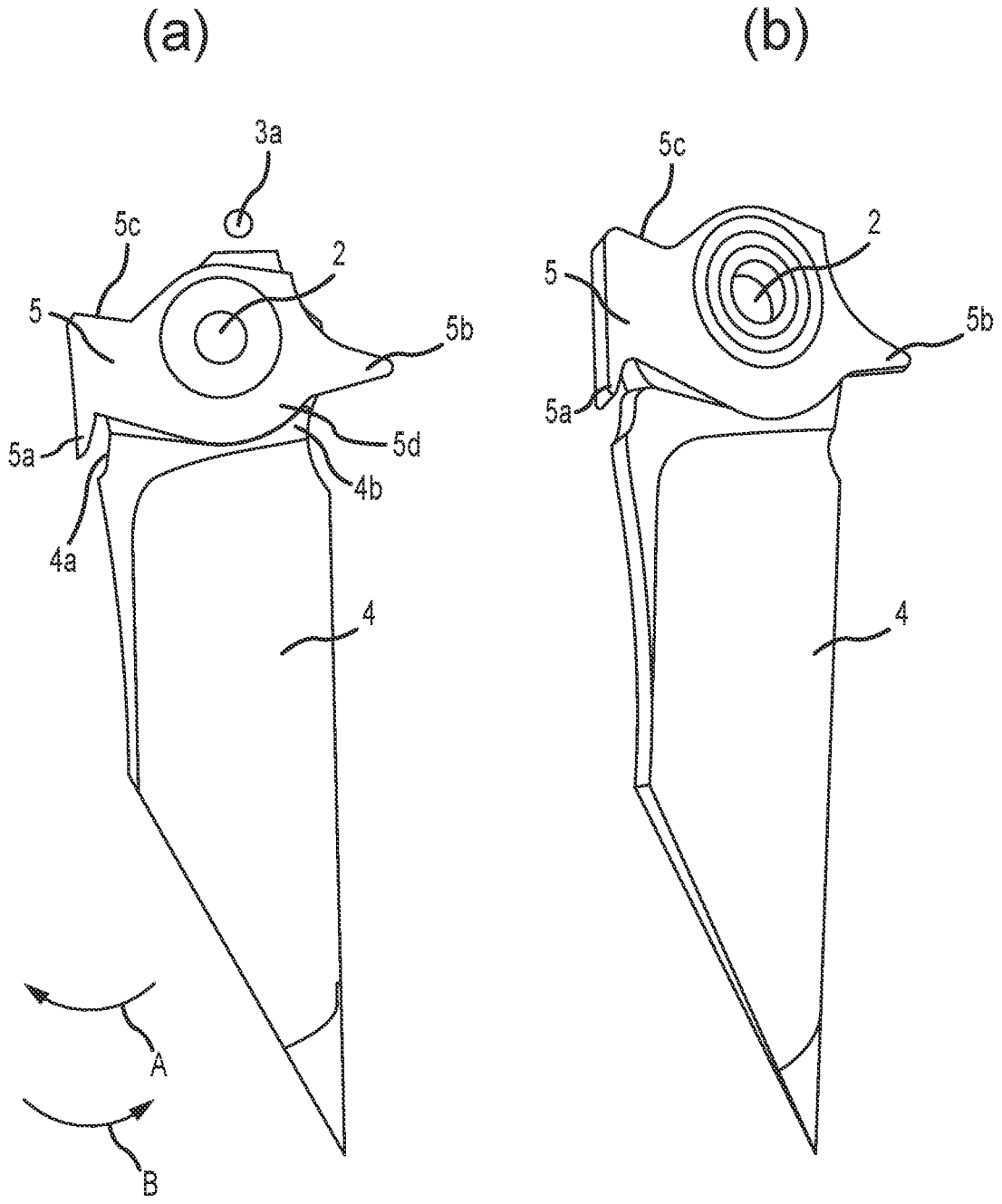
FIG. 2B consists of diagrams illustrating the folding knife in the course of transitioning from its closed state to its open state according to Embodiment 1, in which (a) is a side view of the blade and the movable piece, and (b) is an oblique view of the blade and the movable piece.
Figure 3:
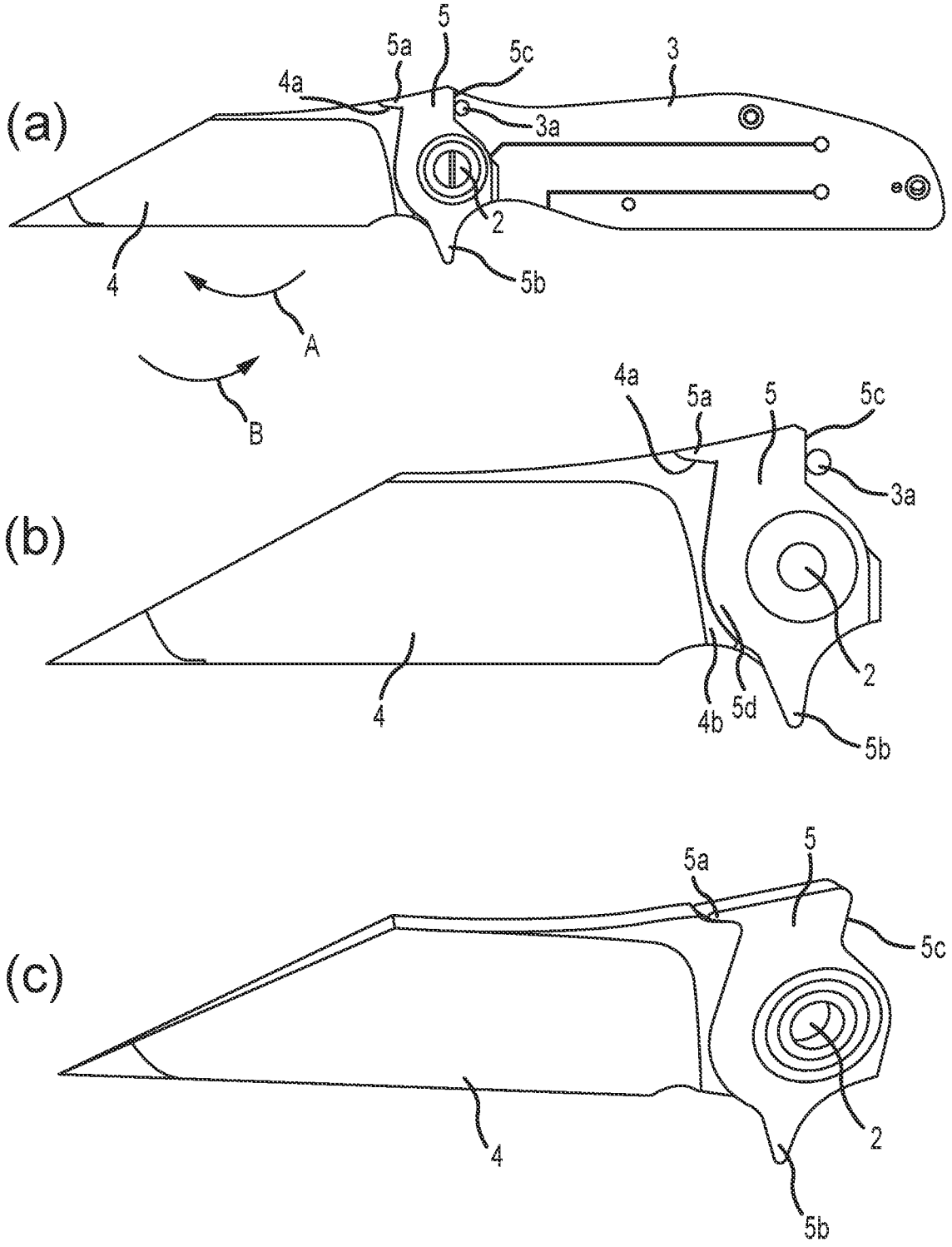
FIG. 3 consists of diagrams illustrating the folding knife in its open state according to Embodiment 1, in which (a) is a schematic side view of the whole knife in Embodiment 1, (b) is a side view of the blade and the movable piece, and (c) is an oblique view of the blade and the movable piece.

Embodiments of the present invention will now be described with reference to the drawings. FIG. 1 consists of diagrams illustrating the folding knife of Embodiment 1 in its closed state. FIGS. 2A and 2B are diagrams illustrating the folding knife of Embodiment 1 in the course of transitioning from its closed state to its open state. FIG. 3 consists of diagrams illustrating the folding knife of Embodiment 1 in its open state.

In FIGS. 1-3, 1 is a folding knife, 2 is a rotating shaft portion, 3 is a handle, 3*a* is a pin (stopper) provided at a position on the handle 3 near the rotating shaft portion 2, 4 is a blade connected to the handle 3 via the rotating shaft portion 2, 4*a* is a notch or recess with a specific shape that is formed at a position on the blade 4 near the rotating shaft portion 2, and at a position on the opposite side from the cutting edge of the blade 4 (the back side), 4*b* (see FIG. 1 (*b*), etc.) is a curved surface portion of the blade 4 that is formed at a position on the cutting edge side of the blade 4 near the rotating shaft portion 2 and is formed in a curved surface shape that is concentric with the rotating shaft portion 2, 5 is a movable piece that is connected to the handle 3 and the blade 4 via the rotating shaft portion 2, 5*a* is a protrusion that is formed in a shape corresponding to the notch 4*a* (a shape that can be disposed or accommodated in the notch 4*a*) at a position facing the notch 4*a* in the movable piece 5, 5*b* is a protruding flip tab (first stopper contact portion) that is formed at a position on the movable piece 5 that is substantially on the opposite side from the protrusion 5*a*, 5*c* is a contact portion (second stopper contact portion) formed at a position on the movable piece 5 that is near the protrusion 5*a* in the blade opening direction (the arrow A direction in FIG. 1 (*a*)), and 5*d* is a curved surface portion on the movable piece 5 that is formed in a curved surface shape that can hit the curved surface portion of the blade 4 side.

In addition, in FIG. 1 (*a*), the handle 3 is shown so that the front side in the drawing is transparent, allowing the blade 4 and the movable piece 5 inside to be seen. That is, in its closed state, the blade 4 and the movable piece 5 are accommodated in a groove portion in the center of the handle 3 (see FIG. 1 (*a*)), but in FIG. 1 (*a*), we can see through the front side of the handle 3, allowing the blade 4 and the movable piece 5 accommodated inside the handle 3 to be visible.

In Embodiment 1, for example, the blade 4, which is formed by grinding down a stainless steel material, the movable piece 5, which is formed by grinding down a titanium alloy, and the handle 3, in which plastic covers are affixed to the outside of a liner formed by grinding down a titanium alloy, for example, are connected and linked by the rotating shaft portion 2 as shown in FIG. 1 (*a*).

Also, in Embodiment 1, the blade 4 is connected to the handle 3 via the rotating shaft portion 2 so as to be rotatable within a range of about 0 degrees to about 180 degrees with respect to the handle 3. The movable piece 5 is configured separately from the blade 4. The movable piece 5 is attached to the blade 4 and the handle 3 via the rotating shaft portion 2.

In Embodiment 1, as shown in FIG. 1, the flip tab 5*b* is disposed so as to be able to hit the pin 3*a* (stopper) on the handle side when the movable piece 5 rotates to the closed blade state. Also, as shown in FIG. 3, the contact portion 5*c* is disposed so as to be able to hit the pin 3*a* (stopper) on the handle side when the movable piece 5 rotates to the open blade state.

In Embodiment 1, as described above, the protrusion 5*a* in the movable piece 5 is formed at a position where it can be disposed or accommodated in the notch 4*a* in the blade 4, and so as to have a shape that can be disposed or accommodated in the notch 4*a* in the blade 4. Also, in Embodiment 1, the protrusion 5*a* is formed at a position away from the notch 4*a* of the blade 4 by a specific rotation angle (see α in FIG. 1 (*b*)) in its closed state shown in FIG. 1, in the blade opening direction (the direction of arrow A in FIGS. 2A and 2B).

In Embodiment 1, as shown in FIGS. 2A and 2B, the end portion of the movable piece 5 facing the back side of the blade 4, and the end portion on the back side of the blade 4 facing the movable piece 5 are facing each other with a slight gap (a substantially fan-shaped gap corresponding to the rotation angle indicated by a in FIG. 1 (*b*)). Consequently, the movable piece 5 and the blade 4 are configured to be able to rotate relative to each other only within the range of the above-mentioned gap, that is, within a specific rotation angle, such as 10 to 20 degrees (see α in FIG. 1 (*b*)).

In Embodiment 1, as shown in FIGS. 2A and 2B, outside the above-mentioned specific rotation angle, such as a rotation angle of 10 to 20 degrees (see α in FIG. 1 (*b*)), the curved surface portion 5*d* (a portion that is concentric with the rotating shaft portion 2) formed on the blade 4 side of the movable piece 5 hits the curved surface portion 4*b* (a portion that is concentric with the rotating shaft portion 2) on the movable piece 5 side of the blade 4. Consequently, in Embodiment 1, the movable piece 5 is linked to the blade 4 and rotates together with the blade 4 outside the above-mentioned specific rotation angle, such as a rotation angle of 10 to 20 degrees (see α in FIG. 1 (*b*)).

In Embodiment 1, the pin 3*a* (stopper) on the handle 3 side and the flip tab 5*b* (first stopper contact portion) on the movable piece 5 side serve to dispose the protrusion 5*a* outside of the notch 4*a* of the blade 4 and to protrude from the blade 4 (see FIG. 1) when the blade 4 transitions from its open state to its closed state and the flip tab 5*b* hits the pin 3*a* (the state shown in FIG. 1). That is, the pin 3*a* (stopper) on the handle 3 side and the flip tab 5*b* on the movable piece 5 side serve to create a state in which the protrusion 5*a* is disposed outside of the notch 4*a* of the blade 4 and protrudes from the blade 4 when the blade 4 has transitioned to its closed state, and also serve to prevent the protrusion 5*a* disposed outside of the notch 4*a* of the blade 4 from rotating in the blade closing direction (the direction of arrow B in FIG. 1) and from being accommodated in the notch 4*a*.

Also, in Embodiment 1, the pin 3*a* (stopper) on the handle 3 side and the contact portion 5*c* (second stopper contact portion) on the movable piece 5 side serve to dispose and accommodate the protrusion 5*a* in the notch 4*a* of the blade 4 when the blade 4 transitions from its closed state to its open state and the contact portion 5*c* hits the pin 3*a* (the state shown in FIG. 3). That is, the pin 3*a* (stopper) on the handle 3 side and the contact portion 5*c* on the movable piece 5 side serve to dispose and accommodate the protrusion 5*a* in the notch 4*a* of the blade 4 when the blade 4 transitions to its open state, and also serve to prevent the blade 4 and the movable piece 5, including the protrusion 5*a*, from rotating further in the blade opening direction (the arrow A direction in FIG. 3) than in its open state shown in FIG. 3 and going to the outside of the notch 4*a*.

Also, in Embodiment 1, when the blade 4 is neither in its open state nor in its closed state and is instead in the course of transitioning between these states, the movable piece 5 rotates in conjunction with the blade 4 (together with the blade 4) when rotated outside the range of a specific rotation angle (see α in FIG. 1 (*b*)), but is able to rotate freely with respect to the blade 4 when rotated within the range of said rotation angle (see α in FIG. 1 (*b*)).

The reason why the movable piece 5 rotates in conjunction with the movement of the blade 4 (together with the blade 4) when rotated outside the range of the specific rotation angle (see α in FIG. 1 (*b*)) is that, as shown in FIGS. 2A and 2B, outside the range of this rotation angle, the curved surface portion 5*d* of the movable piece 5 hits the curved surface portion 4*b* of the blade 4, and the movable piece 5 is linked to the blade 4. On the other hand, the reason why the movable piece 5 can rotate freely with respect to the blade 4 when the movable piece 5 rotates within the range of said rotation angle (see α in FIG. 1 (*b*)) is that, as shown in FIGS. 2A and 2B, the curved surface portion 5*d* (a portion that is concentric with the rotating shaft portion 2) of the movable piece 5 that hits the curved surface portion 4*b* (a portion that is concentric with the rotating shaft portion 2) on the blade 4 side is not formed at the portion of the movable piece 5 near the protrusion 5*a*, and a substantially fan-shaped gap is formed between the portion of the movable piece 5 near the protrusion 5*a* and the portion on the blade 4 side facing this protrusion 5*a*.

The operation of Embodiment 1 will now be described. In Embodiment 1, by having the rotating shaft portion 2, the pin 3*a* (stopper) formed on the handle 3, the flip tab 5*b* formed on the movable piece 5, the contact portion 5*c* formed on the movable piece 5, the curved surface portion 5*d* formed on the movable piece 5, and the curved surface portion 4*b* formed on the blade 4, a rotation mechanism portion is configured that allows the blade 4 and the movable piece 5 to rotate relative to the handle 3 as well as the movable piece 5 to rotate relative to the blade 4 only within a specific rotation angle (the angle indicated by a in FIG. 1 (*b*)). In Embodiment 1, the following operation is performed by this configuration.

First, the operation in its closed state in which the blade 4 is disposed or accommodated in the handle 3 will be described with reference to FIG. 1. At the stage where the transition from the open blade state to the closed blade state is complete, the blade 4 is disposed or accommodated in a state of having moved as much as possible toward the back of the inside of the handle 3. In this closed blade state, as shown in FIG. 1, the flip tab 5*b* on the movable piece 5 side hits the pin 3*a* (stopper) on the handle 3 side. Consequently, the movable piece 5 is prevented from rotating further in the blade closing direction (the direction of arrow B in FIG. 1 (*a*)) than its closed state shown in FIG. 1 with respect to the blade 4. Consequently, the protrusion 5*a* of the movable piece 5 is disposed and held outside of the notch 4*a* of the blade 4, that is, at a position away from the notch 4*a* of the blade 4 by a specific rotation angle (the rotation angle indicated by a in FIG. 1 (*b*)) in the blade opening direction (the direction of arrow A in FIG. 1 *a*)). Consequently, the protrusion 5*a* is in a state of protruding from the back side of the blade 4 (the opposite side from the cutting edge), so that when the user removes the knife from a pouch or pocket, the protrusion 5*a* will hit a part of the pouch or pocket and the blade 4 will rotate. In its closed state, the blade 4 is locked by a known means so as not to come out of the handle 3 easily.

Next, the operation of the blade 4 in the course of transitioning from its closed state to its open state will be described with reference to FIGS. 2A and 2B. As described above, outside of the specific rotation angle (the angle indicated by a in FIG. 1 (*b*)), the curved surface portion 5*d* on the movable piece 5 side hits the curved surface portion 4*b* on the blade 4 side, and as a result, the movable piece 5 and the blade 4 are linked to each other. Therefore, outside the specific rotation angle (the angle indicated by a in FIG. 1 (*b*)), the movable piece 5 will rotate with respect to the handle 3 together with the blade 4. Consequently, while the blade 4 is in the course of transitioning from its closed state to its open state, the movable piece 5 basically rotates in the blade opening direction (the direction of arrow A in FIGS. 2A and 2B) together with the blade 4 with respect to the handle 3 and transitions to its open state (discussed below) (see FIG. 3).

Next, the operation in its open state in which the blade 4 is fully opened from the handle 3 will be described with reference to FIG. 3. When the blade 4 transitions to its open state, the movable piece 5 and the blade 4 rotate together as much as possible in the blade opening direction (the direction of arrow A in FIG. 3 (*a*)). In the course of this, when the contact portion 5*c* of the movable piece 5 hits the pin 3*a* (stopper) of the handle 3, the movable piece 5 is prevented from rotating further in the blade opening direction than the state shown in FIG. 3. As a result, the protrusion 5*a* of the movable piece 5 is disposed and accommodated in the notch 4*a* of the blade 4. At the same time, the end portion of the movable piece 5 near the protrusion 5*a* and the end portion of the blade 4 near the notch 4*a* hit each other. As a result, the blade 4 is also prevented from rotating further in the blade opening direction than the state shown in FIG. 3 due to the presence of the contact portion 5*c* of the movable piece 5 and the pin 3*a* (stopper) of the handle 3. In its open state, the blade 4 is locked by a known means so as not to rotate easily in the direction of the handle 3 from the state of being fully opened from the handle 3 as shown in FIG. 3.

The operation of the blade 4 in the course of transitioning from its open state to its closed state will be described with reference to FIGS. 2A and 2B. As described above, the movable piece 5 is configured to be relatively rotatable with respect to the blade 4 within a specific rotation angle (the angle indicated by a in FIG. 1 (*b*)), but outside the range of the specific rotation angle (the angle indicated by a in FIG. 1 (*b*)), the movable piece 5 rotates together with the blade 4 with respect to the handle 3. Consequently, while the blade 4 is in the course of transitioning from its open state to its closed state, the movable piece 5 basically rotates along with the blade 4 with respect to the handle 3 in the blade closing direction (the direction of arrow B in FIGS. 2A and 2B) and transitions to the above-mentioned closed blade state (see FIG. 1).

As described above, in Embodiment 1, a rotation mechanism is provided that allows the blade 4 and the movable piece 5 to rotate relative to the handle 3, and that allows the movable piece 5 to rotate relative to the blade 4 only within the range of a specific rotation angle (see α in FIG. 1 (*b*)), the rotation mechanism allows the movable piece 5 to rotate relative to the blade 4 only within the range of a specific rotation angle α, so that in its open state the protrusion 5*a* will be disposed or accommodated inside the notch 4*a* of the blade 4, and in its closed state the protrusion 5*a* will be disposed outside of the notch 4*a* of the blade 4. Consequently, with Embodiment 1, in its open state in which the blade 4 is fully opened from the handle 3, the protrusion 5*a* of the movable piece 5 will be disposed or accommodated inside the notch 4*a* of the blade 4. Consequently, the problem that occurred with a conventional folding knife, in which the protrusion on the blade 4 side ended up hitting the user's thumb when the user put his thumb on the blade 4 and tried to push the blade 4 down from above in its open state, can be effectively avoided.

Also, in Embodiment 1, there are provided the flip tab 5*b* on the movable piece 5 side which prevents the movable piece 5 (the movable piece 5 disposed outside of the notch 4*a* of the blade 4) from rotating in the blade closing direction by hitting the pin 3*a* on the handle 3 side because when the blade 4 is in its closed state, the protrusion 5*a* is disposed outside of the notch 4*a* of the blade 4, as well as the contact portion 5*c* on the movable piece 5 side which prevents the movable piece 5 (the movable piece 5 disposed or accommodated inside the notch 4*a* of the blade 4) from rotating in the blade opening direction by hitting the pin 3*a* on the handle 3 side because when the blade 4 is in its open state, the protrusion 5*a* is disposed or accommodated inside the notch 4*a* of the blade 4. Consequently, with Embodiment 1, when the blade 4 is in its closed state, the protrusion 5*a* can be reliably disposed outside of the notch 4*a* of the blade 4, and when the blade 4 is in its open state, the protrusion 5*a* can be reliably disposed or accommodated inside the notch 4*a* of the blade 4.

Also, in Embodiment 1, the notch 4*a* is formed at a position on the blade 4 near the rotating shaft portion 2 and on the opposite side (back side) from the cutting edge, and the protrusion 5*a* is formed at a position on the movable piece 5 facing the notch 4*a* and in a shape corresponding to the notch 4*a*, so when the blade 4 has completed the transition from its closed state to its open state, the protrusion 5*a* is reliably disposed or accommodated inside the notch 4*a*.

Also, in Embodiment 1, the protrusion 5*a* is formed so that when the blade is in its closed state, the protrusion 5*a* is disposed at a position away from the notch 4*a* of the blade 4 of the movable piece 5 by a specific rotation angle α in the blade opening direction, so when the user removes the knife from a holster or pocket, the protrusion 5*a* reliably catches on a part of the holster or pocket, and as a result the blade 4 is reliably rotated so as to come out of the handle 3.

Furthermore, in Embodiment 1, the rotation mechanism is configured such that (a) when the blade 4 is in its closed state, the protrusion 5*a* on the movable piece 5 side is disposed and held at a position away from the notch 4 formed on the back side of the blade 4 near the rotating shaft portion by a specific rotation angle in the blade opening direction, (b) while the blade 4 is in the course of transitioning from its closed state to its open state, if the movable piece 5 is within the specific rotation angle, the movable piece 5 is able to rotate relative to the blade 4, and if the movable piece 5 is outside the specific rotation angle, the movable piece 5 is rotated with respect to the handle 3 together with the blade 4, (c) in its open state in which the blade 4 is fully opened from the handle 3, a protrusion 5*a* of the movable piece 5 is disposed or accommodated in the notch 4*a* of the blade 4, and (d) while the blade 4 is in the course of transitioning from its open state to its closed state, if the movable piece 5 is within the specific rotation angle, the movable piece 5 is able to rotate relative to the blade 4, and if the movable piece 5 is outside the specific rotation angle, the movable piece 5 is rotated with respect to the handle 3 together with the blade 4. Consequently, in Embodiment 1, in its open state in which the blade 4 is fully opened from the handle 3, the protrusion 5*a* on the blade 4 side will be disposed or accommodated inside the notch 4*a* of the blade 4, and the problem that occurred with a conventional folding knife, in which the protrusion on the blade 4 side ended up hitting the user's thumb, can be effectively avoided.

Second Embodiment

Embodiment 2 of the present invention will now be described with reference to FIG. 4. The basic configuration of Embodiment 2 is the same as that of Embodiment 1, so the following description will focus on the parts that are different.

Figure 4:
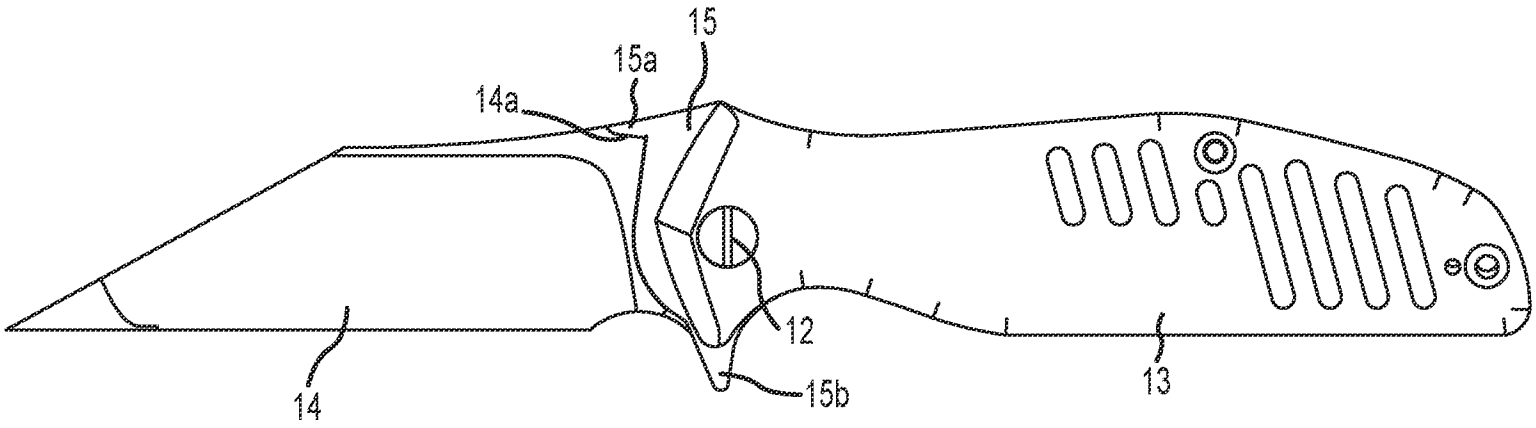
FIG. 4 is a schematic side view illustrating the folding knife in its open state according to Embodiment 2 of the present invention.
Figure 5:
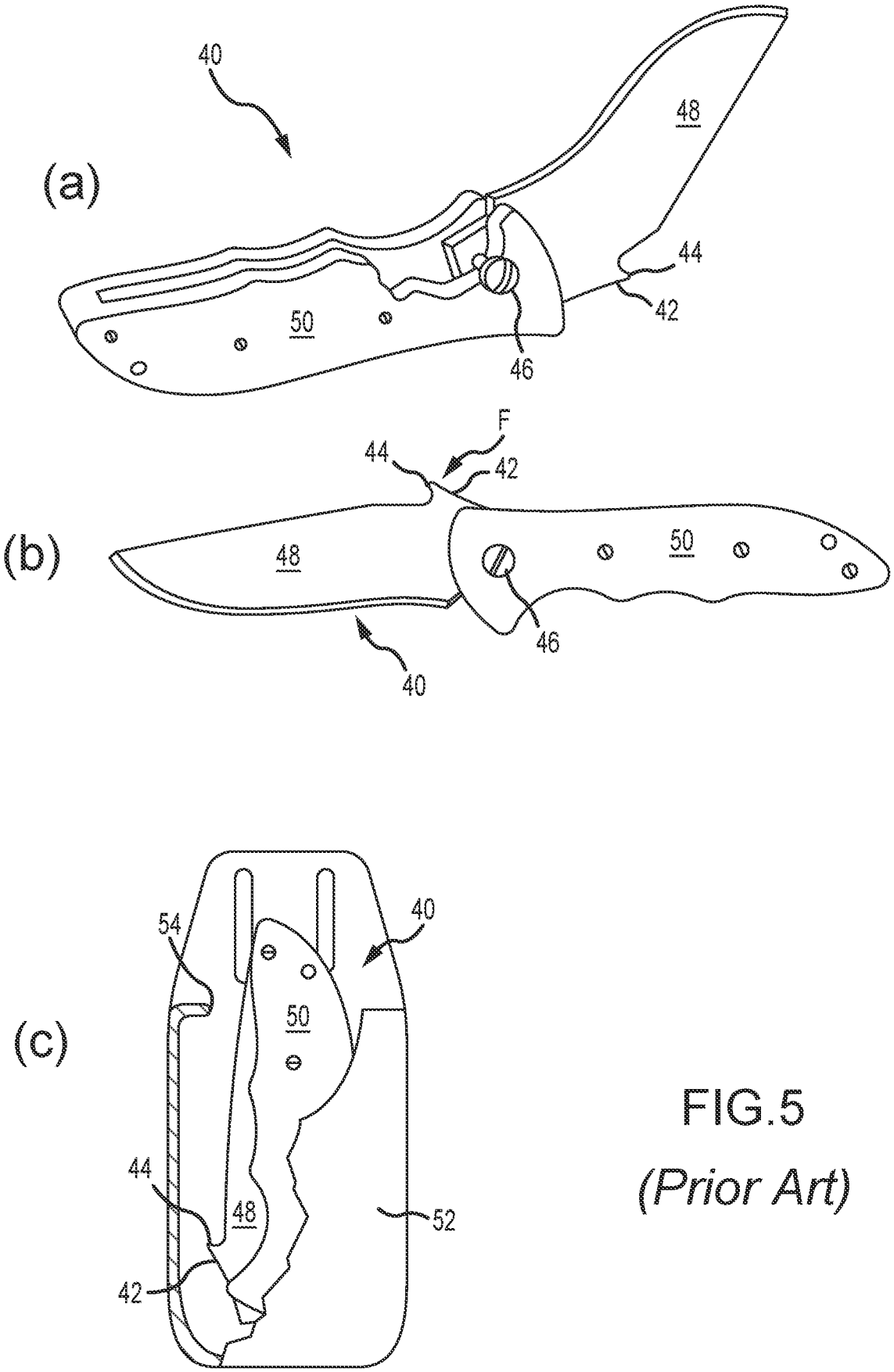
FIG.5 (Prior Art)
FIG. 5 consists of diagrams of prior art folding knife, where the prior art folding knife is configured such that a protrusion is formed on a part of a blade, and when the knife is taken out of a holster or a pocket, the protrusion catches on a part of the holster or the pocket and the blade is automatically opened from the handle, where (a) is an oblique view of the folding knife in a partly open position. (b) is a side view of the folding knife in an open position, and (c) is a rotated side view of the folding knife in a closed position and stored in the holster.

In FIG. 4, 13 is a handle, 14 is a blade that is rotatably attached to the handle 3 via a rotating shaft portion 12, and 15 is a movable piece that is disposed between the handle 13 and the blade 14 and is connected to the handle 3 and the blade via the rotating shaft portion 12.

The movable piece 15 is configured to be rotatable with respect to the handle 13 within a range of about 0 degrees to about 180 degrees. Also, the movable piece 15 is configured to be relatively rotatable with respect to the blade 14 within the range of a specific rotation angle (see α in FIG. 1 (*b*)), and to rotate together with the blade 14 outside this range of angles.

Also, the protrusion 15*a* is formed at one end portion of the movable piece 5, and the flip tab 15*b* (which hits the stopper provided on the handle 3 side and prevents the movable piece 15 from rotating in the blade closing direction in its closed state) is formed at the other end portion.

As described above, the configuration in Embodiment 2 is basically the same as that in Embodiment 1. Consequently, the same action and effect as those described in Embodiment 1 above can also be obtained in this Embodiment 2.

Although Embodiments 1 and 2 of the present invention were described above, the present invention is not limited to what was described as Embodiments 1 and 2, and various improvements and modifications can be made. For instance, in Embodiment 1, the portion on the blade 4 where the protrusion 5*a* of the movable piece 5 is disposed and accommodated when the blade 4 is in its open state was called "the notch 4*a*," but in the present invention, a "recessed portion" (concave portion) may be used instead of a "notch," and the protrusion 5*a* may be disposed on this recessed portion.

DESCRIPTION OF THE REFERENCE NUMERALS

1 knife
2, 12 rotating shaft portion
3, 13 handle
3*a* pin (stopper)
4, 14 blade
4*a* notch or recess
4*b*, 5*d* curved surface portion
5, 15 movable piece
5*a*, 15*a* protrusion
5*b*, 15*b* flip tab (first stopper contact portion)
5*c* contact portion (second stopper contact portion)
40 knife
42, 44 protrusion
46 rotating shaft
48 blade
50 handle
52 holster
54 part of holster
A blade opening direction
B blade closing direction
F thumb location

The invention claimed is:

1. A folding knife in which a blade and a handle are rotatably connected to each other so as to be able to transition between a closed state in which the blade is accommodated in the handle, and an open state in which the blade is fully open from the handle, said folding knife comprising:

a movable piece that is attached to the blade and the handle, wherein the movable piece is rotatable within a specific rotation angle with a rotation of the blade, and wherein the movable piece is able to rotate with respect to the handle together with the blade outside of the specific rotation angle;

a notch formed at a position on a back side of the blade;

a protrusion that is formed at a position on the movable piece and in a shape corresponding to the notch of the blade, said protrusion being capable of being accommodated in the notch of the blade when the blade is in the open state; and a shaft portion positioned through the handle, the blade, and the movable piece, which allows the blade and the movable piece to rotate relative to the handle, said shaft portion allows the movable piece to rotate relative to the blade only within the specific rotation angle, wherein the notch on the back side of the blade is positioned near the shaft portion, wherein the movable piece is rotatable relative to the blade so that the protrusion is accommodated in the notch of the blade when the blade is in the open state, and so that the protrusion is disposed outside the notch of the blade when the blade is in the closed state, and wherein the specific rotation angle is defined as a range from when the blade is in the closed state with the protrusion disposed outside of the notch of the blade to when the protrusion is accommodated in the notch of the blade.

2. The folding knife according to claim 1, further comprising:

a stopper that is formed on a part of the handle;

a first stopper contact portion that is formed on the movable piece, said first stopper contact portion hitting the stopper when the blade is in the closed state, thereby preventing rotation of the movable piece in a blade closing direction in which the blade rotates from the open state to the closed state, so that the protrusion is disposed outside of the notch of the blade; and a second stopper contact portion that is formed on the movable piece, said second stopper contact portion hitting the stopper when the blade is in the open state, thereby preventing rotation of the movable piece in a blade opening direction in which the blade rotates from the closed state to the open state, so that the protrusion is accommodated in the notch of the blade.

3. The folding knife according to claim 1, wherein the notch is formed in the blade at a position on an opposite side from a cutting edge of the blade.

4. The folding knife according to claim 1, wherein when the blade is in the closed state, the protrusion is disposed at a position away from the notch of the blade by a specific angle in a blade opening direction in which the blade rotates from the closed state to the open state.

5. The folding knife of claim 1, wherein the specific rotation angle is between 10 and 20 degrees.

6. A folding knife in which a blade and a handle are rotatably connected to each other so as to be able to transition between a closed state in which the blade is accommodated in the handle, and an open state in which the blade is fully open from the handle, said folding knife comprising:

a notch formed in the blade at a position on an opposite side from a cutting edge of the blade;

a movable piece that is rotatably connected to the handle and at least partially rotatably connected to the blade;

a protrusion on the movable piece, wherein when the blade is in the closed state, the protrusion is disposed at a position facing the notch and at a position away from the notch by a specific rotation angle in a blade opening direction in which the blade rotates from the closed state to the open state, wherein said protrusion is formed in a shape corresponding to the notch; and a shaft portion positioned through the handle, the blade, and the movable piece, which allows the movable piece to at least partially rotate in conjunction with the blade, and wherein the notch is formed on a back side of the blade near the shaft portion, wherein while the blade transitions from the closed state to the open state, or while the blade transitions from the open state to the closed state, the movable piece is able to rotate with respect to the blade within the specific rotation angle and the movable piece is rotated with respect to the handle together with the blade outside the specific rotation angle, wherein the specific rotation angle is defined as a range from when the blade is in the closed state with the protrusion disposed outside of the notch of the blade to when the protrusion is accommodated in the notch of the blade, and wherein in the open state in which the blade is fully opened from the handle, the protrusion on the movable piece is accommodated in the notch of the blade.

7. The folding knife according to claim 6, wherein the notch is formed in the blade at a position on an opposite side from a cutting edge of the blade.

8. The folding knife according to claim 6, wherein when the blade is in the closed state, the protrusion is disposed at a position away from the notch of the blade by a specific angle in the blade opening direction.

* * * * *